US006616090B1

(12) United States Patent
Stamps

(10) Patent No.: US 6,616,090 B1
(45) Date of Patent: Sep. 9, 2003

(54) WIRE SUPPLY CONTROL ASSEMBLY FOR FEEDING WIRE

(75) Inventor: Timothy C. Stamps, Carl Junction, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/540,157

(22) Filed: Mar. 31, 2000

(51) Int. Cl.[7] ..... B65H 57/18
(52) U.S. Cl. ..... 242/566; 242/157.1; 242/417.3
(58) Field of Search ..... 242/417.3, 566, 242/593, 157.1, 147 R, 128, 154

(56) References Cited

U.S. PATENT DOCUMENTS 316,917 A * 4/1885 Russell
457,082 A * 8/1891 Holbrook
988,444 A * 4/1911 Corley et al.
1,156,913 A * 10/1915 Marcroft
1,508,503 A * 9/1924 Brown et al. ..... 139/214
1,948,438 A * 2/1934 Brunet et al. ..... 242/18
2,159,635 A * 5/1939 Ranney ..... 242/25
2,191,082 A * 2/1940 Parker ..... 100/31
2,349,873 A * 5/1944 Lisy ..... 242/128
2,419,808 A * 4/1947 Wirth ..... 242/156
2,605,055 A * 7/1952 Scott et al. ..... 242/45
2,992,792 A * 7/1961 Van Der Hoek ..... 242/128
3,447,448 A * 6/1969 Pasic ..... 100/4
3,621,888 A 11/1971 Ericsson
3,720,158 A 3/1973 Sauer et al.
3,834,297 A 9/1974 Huson
3,863,558 A 2/1975 Trumbo
3,910,089 A 10/1975 Meier et al.
3,921,799 A 11/1975 Meier
3,935,616 A 2/1976 Simmons
3,963,191 A * 6/1976 Goodley ..... 242/75.43
3,990,652 A * 11/1976 Brown ..... 242/129.8
4,031,594 A 6/1977 Cepuritis
4,043,155 A * 8/1977 Steinberg et al. ..... 66/132 T
4,048,697 A 9/1977 Duenser
4,062,086 A 12/1977 Wojcik
4,079,667 A 3/1978 Lems et al.
4,080,689 A 3/1978 Meier
4,090,440 A 5/1978 Jensen
4,120,238 A * 10/1978 Schafer et al. ..... 100/11
4,139,976 A * 2/1979 Herrig et al. ..... 53/429
4,156,385 A 5/1979 Lems et al.
4,158,994 A 6/1979 Jensen
4,226,007 A 10/1980 Duenser
4,228,565 A 10/1980 Lems et al.

(List continued on next page.)

*Primary Examiner*—Donald P. Walsh
*Assistant Examiner*—Joseph Rodriguez
(74) *Attorney, Agent, or Firm*—Husch & Eppenberger, LLC; Grant D. Kang, Esq.; Robert C. Haldiman, Esq.

(57) ABSTRACT

A wire supply control assembly for creating a length of slack wire in readiness for use. The slack wire is stored by arching a length of wire upward along a feeder arm and downward to a baling machine. The wire feeder arm is biased in an upward position by a spring.

23 Claims, 1 Drawing Sheet

U.S. PATENT DOCUMENTS 4,332,339 A * 6/1982 Luedemann et al. ..... 226/195
4,378,262 A 3/1983 Annis, Jr.
4,391,186 A 7/1983 Davis
4,466,535 A 8/1984 Huson
4,484,518 A 11/1984 Jaenson
4,496,113 A * 1/1985 Dawson ..... 242/67.1 R
4,501,356 A 2/1985 Urban et al.
4,570,874 A * 2/1986 Takeda ..... 242/147 R
4,611,534 A 9/1986 Kudlicka et al.
4,625,635 A 12/1986 Lewis
4,665,815 A 5/1987 Fleissner
4,787,425 A 11/1988 Saylor
4,951,562 A 8/1990 Ribaldo
5,031,847 A * 7/1991 Tanaka ..... 242/54
5,039,250 A 8/1991 Janz
5,040,741 A * 8/1991 Brown ..... 242/128
5,100,074 A * 3/1992 Jones ..... 242/420.6
5,117,536 A 6/1992 Beach et al.
5,133,532 A 7/1992 Figiel et al.
5,249,472 A * 10/1993 Brown ..... 73/862.472
5,379,687 A 1/1995 Moseley
5,417,320 A 5/1995 Velan et al.
5,477,724 A 12/1995 Velan et al.
5,483,837 A 1/1996 Velan et al.
5,520,351 A * 5/1996 Prospero et al. ..... 242/419.7
5,546,855 A 8/1996 Van Doorn et al.
5,689,934 A 11/1997 Scherer et al.
5,791,584 A * 8/1998 Kuroiwa ..... 242/417.3
5,826,499 A 10/1998 Bullington

* cited by examiner

WIRE SUPPLY CONTROL ASSEMBLY FOR FEEDING WIRE

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of the Invention

This invention relates generally to wire feeders and, more particularly, wire feeders for bale binding machines.

2. Related Art

Bale forming and binding machines require a feed of a binding wire from a supply source. The means and mode of supply must be compatible with the binding machine as well as the constraints of the operational setting. One such arrangement of a combination wire feeder and bale binding machine is known as U.S. Wire-Tie™ Systems Model 340 Tier System. Specifically, a wire feeder is shown on page 3 of U.S. Wire-Tie™ Systems 340 Series Automatic Wire Tying Head Operating & Maintenance Instructions and Repair Parts List.

There are several difficulties presented by conventional fixed action strapping supply equipment. One difficulty is that a wire feeder has considerable floor space requirements, both for the feeder itself as well as for clearance in its vicinity. Normally, at least some slack in the wire between the wire feeder and the bale binding machine is required for proper operation. Otherwise, if the wire in this section is kept too taut, an increased amount of force is necessary to draw additional wire. This increased force prevents the binding machine from operating properly. If there is too much slack in the wire between the feeder and the baling machine, the wire poses a safety hazard. As the slack wire is drawn into the baling machine, there is a fairly violent and fast acceleration of the wire. This moving wire has the potential to strike operators while the binding machine is operating, and has the potential to strike and damage nearby machinery.

Thus, in the prior art, as wire is drawn from a wire feeder, some slack wire surges horizontally and upwardly from between the wire feeder to the baling machine. Once the slack is gone, the baling machine supplies the requisite force necessary to draw an additional length of needed wire. This additional length is the amount of wire necessary to complete the draw length needed by the baling machine together with the amount necessary to provide a subsequent additional length of wire to the same slackness (making ready to repeat the cycle). Alternatively, when the wire feeder is set the appropriate floor distance away from the baling machine such that no additional amount of wire is necessary to complete the draw length, the additional length is the amount of wire necessary to complete provide a subsequent additional length of wire to the same slackness as before (making ready to complete the cycle). In both situations, the baling machine provides the force necessary to draw a length of wire to create a slack wire segment.

SUMMARY OF THE INVENTION

It is in view of the above problems that the present invention was developed. The invention is a wire supply control assembly that supplies wire from a wire feeder to a baling machine. The wire supply control assembly of the present invention reduces the amount of required floor space by drawing the slack upwardly (instead of horizontally as in the prior art). It is the wire supply control assembly that draws the slack upwardly, not the baling machine.

The wire supply control assembly has a wire feeder arm that is pivotally coupled to a wire feeder arm assembly. The wire feeder arm is spring biased to an up position. This higher vertical position creates a length of slack wire equal to at least two times the vertical height of the wire feeder arm.

When the baling machine draws wire, the force of the draw from the baling machine pulls the wire feeder arm downward and makes available the slack created by the formerly vertical position of the wire feeder arm. Once the wire draw is complete, the baling machine ceases to exert drawing force on the wire. In the absence of drawing force, the wire feeder arm moves to its upward, biased position as urged by the spring.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
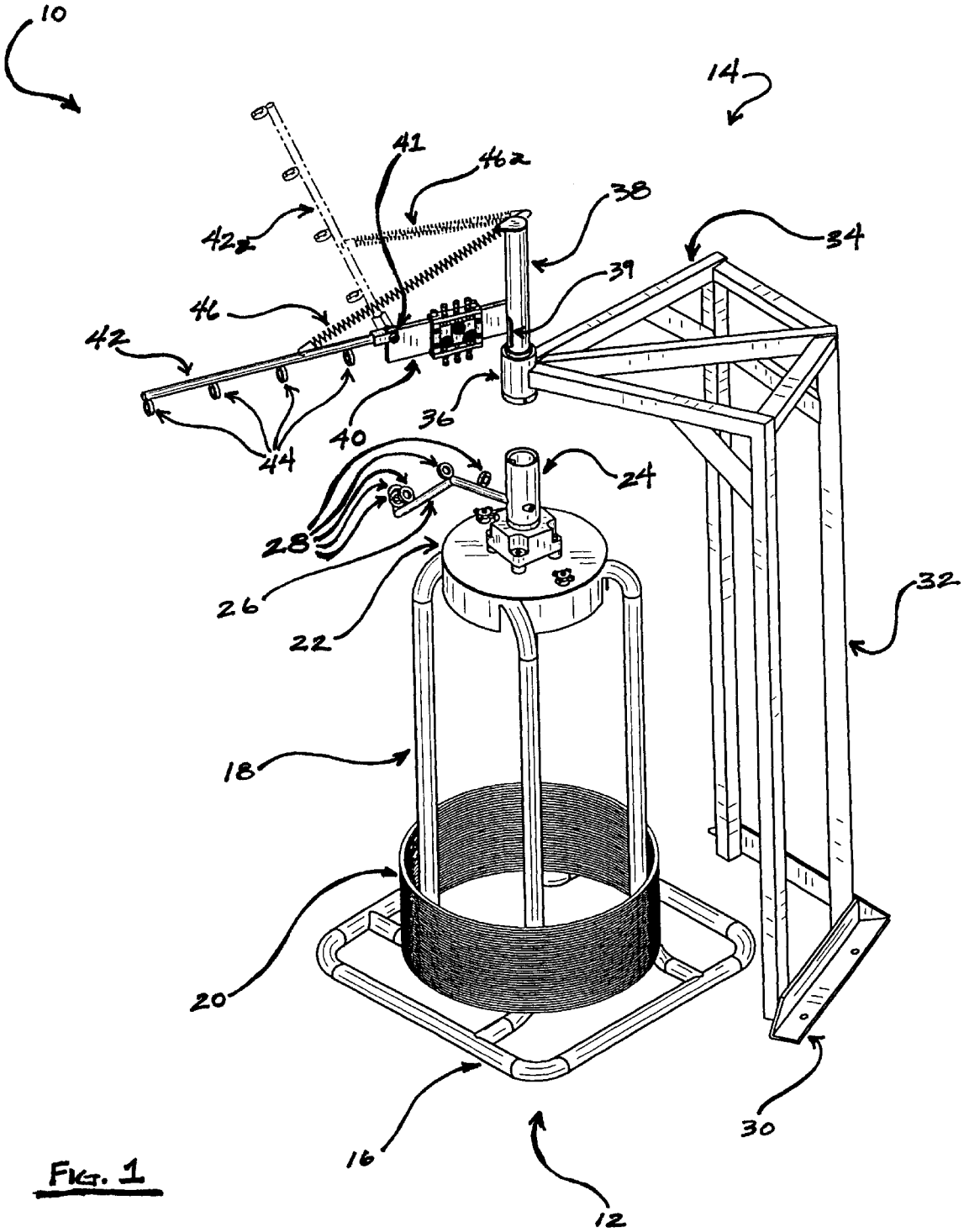
FIG. 1 is a perspective view of the preferred embodiment of the present invention illustrating a wire supply controller and a wire feeder wherein a movable wire guide element of the wire feeder disposed in a first position is shown in solid lines and disposed in a second position is shown in broken lines.

Referring to the accompanying drawings in which like reference numbers indicate like elements, FIG. 1 illustrates a perspective view of the preferred embodiment of the present invention. A wire feeder apparatus 10 consists of a wire supply control assembly 12 and a wire feeder arm assembly 14. A base stand 16 of the wire supply control assembly 12 supports upright legs 18 for maintaining the wire supply 20 in readiness for use. Atop the legs 18 is a wire control support member 22 which in turn bears a vertical wire-directing tube 24. Attached to the tube 24 is a wire control extension arm 26 and a plurality of wire directing rings 28.

In operation the wire is drawn (not depicted) from the supply wire spool 20 through the directing rings 28 into the tube 24 through a port (not depicted) in the side of the tube 24 and directed upward out of the top of tube 24. The wire direction and control from the supply 20 is open to numerous variations in construction which do not impact on the inventive distinction of the present invention and the present invention is not limited to the means depicted.

A base plate 30 of the feeder arm assembly 14 is fixable to the flooring and supports the legs 32 to which are attached the horizontal props 34. Positioned on the end of the props 34 is a vertical feeder arm inlet cylinder 36 from which extends a vertical hollow housing 38. An aperture 39 in the side of the housing 38 is open in the same direction as a brace 40 extends from the housing 38. Wire feeder arm 42 is pivotally coupled at axis 41 to the end of brace 40 and supports wire routing rings 44. Spring 46 is attached at one end to the top of housing 38 and at the other end approximately midway along feeder am 42. In operation the wire is drawn (not depicted) from out of the top of tube 24 into the open bottom (not depicted) of and through cylinder 36 into housing 38, out the aperture 39 and onward through the routing rings 44. The feeder arm 42 and spring 46 are shown in solid lines disposed in the arrangement occurring when wire is drawn into the bale binder (not depicted). The wire supply 20 supplies the wire that is routed through tube 24 and subsequently in the manner described above. The wire is not shown in the drawings to prevent obscuring wire feeder apparatus 10. The movable position of the feeder arm 42 is shown in broken lines which illustrate the positions of the feeder arm 42*a* and the spring 46*a* disposed in the arrangement occurring when wire is not being drawn into the bale binding machine. The configuration of the feeder arm 42 and its support assembly 14, and the wire routing rings 44 and the feeder arm's movement-executing parts (38, 40, 41, 42, 46) are open to numerous variations in construction which do not impact on the inventive distinction of the present invention nor alter the invention's true nature and the present invention is not limited to the means depicted.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, wire routing rings 44 can be replaced with a tube element (not shown), the concept being that of an element for positioning the wire adjacent feeder arm 42 to permit a length of slack wire to be drawn upwardly. Thus, the breadth and scope of the present invention should not be limited by any of the above-described exemplary embodiments, but should be defined only in accordance with the following claims appended hereto and their equivalents.

What is claimed is:

1. A wire feeder apparatus for feeding a supply of baling wire to a baling machine driving mechanism comprising:

a moveable wire feeder arm, said moveable wire feeder arm supporting a wire guide for directing a path of an individual wire from the supply to a wire uptake of the baling machine, said wire guide having an aperture for entry of the wire and an exit loop disposed such that the wire proceeds from said aperture for entry of said wire guide to said exit loop of said wire guide and from said exit loop of said wire guide to the baling machine;

said movable wire feeder arm being moveable between at least two dispositions, in a first of said dispositions said exit loop of said wire guide is disposed proximate to the wire uptake of the baling machine, and in a second of said dispositions said exit loop of said wire guide is disposed at a remove from the wire uptake.

2. A wire feeder apparatus according to claim 1 wherein said second disposition reduces wire slack in said path from the wire supply to the baling machine's wire uptake.

3. A wire feeder apparatus according to claim 2 wherein said second disposition reduces wire slack by maintaining said exit loop of said wire guide at a greater elevation than in said first disposition.

4. A wire feeder apparatus according to claim 1 wherein said path from said wire supply to the baling machine's wire uptake, when said moveable wire feeder arm is in said second disposition provides additional clearance between said path of the wire sand the baling machine.

5. A wire feeder apparatus according to claim 4 wherein said second disposition provides additional clearance by raising said exit loop of said wire guide to a greater elevation than in said first disposition.

6. A wire feeder apparatus according to claim 1 wherein said feeder arm moves by pivoting about an axis in close cooperation with said aperture of said wire guide.

7. A wire feeder apparatus according to claim 6 wherein said movement by pivoting of said feeder arm from said first disposition to said second disposition raises said exit loop of said wire guide.

8. A wire feeder apparatus according to claim 6 wherein said movement by pivoting of said feeder arm from the first disposition to the second disposition reduces slack in said path from the wire supply to the baling machine's wire uptake.

9. A wire feeder apparatus according to claim 6 wherein said movement by pivoting of said feeder arm from said first disposition to said second disposition increases clearance between said path and the baling machine.

10. A wire feeder apparatus according to claim 1 wherein said second disposition is a feeder arm rest position.

11. A wire feeder apparatus according to claim 10 wherein said feeder arm moves from said second disposition to said first disposition in response to a wire drawing action of the baling machine.

12. A wire feeder apparatus according to claim 1 wherein said feeder arm is biased to said second disposition.

13. A wire feeder apparatus according to claim 12 wherein said bias is by a spring.

14. A wire feeder apparatus according to claim 12 wherein a wire drawing action of the baling machine produces sufficient force upon said moveable wire feeder arm to overcome said bias and move said moveable wire feeder arm to said first disposition.

15. A wire feeder apparatus for feeding a baling wire to a baling machine driving mechanism comprising:

a wire reserve device holding a supply of baling wire, said wire reserve device arranging the wire for continuous availability to a wire feeder arm;

said wire reserve device including a wirestorage implement and a wire conveyance, said wire conveyance positioning the wire for entry to said feeder arm, said feeder arm routing the wire to a wire uptake of the baling machine;

said feeder arm having a fixed wire entry port for receiving the wire from said wire conveyance, said feeder arm further having a movable pilot arm for determining a wire path from said fixed wire entry port to the baling machine;

said movable pilot arm having an inlet and an outlet, said inlet receiving the wire from said wire conveyance, said wire then progressing along said moveable pilot arm to and out through said outlet;

said movable pilot arm transiting between a first position and a second position, wherein said moveable first position of said pilot arm disposes said outlet proximate to the baling machine wire uptake and said second position disposes said wire outlet at a remove from the baling machine wire uptake.

16. A wire feeder apparatus according to claim 15 wherein said pilot arm is biased towards said second position.

17. A wire feeder apparatus according to claim 16 wherein said pilot arm moves to said first position in response to a wire drawing action of the baling machine.

18. A method of feeding a baling wire to a baling machine driving mechanism comprising the steps of:

directing an individual baling wire on a path from a supply of the wire to an intake of the baling machine;

controlling said path to substantially follow one of two routes, said routes being determined by a disposition of a moveable wire path guide, said moveable wire guide path having an entry loop and an exit loop;

said path following a first of said routes when said moveable wire path guide is in a first disposition wherein a wire exit loop of said moveable wire path guide is proximate to the intake of the baling machine;

said path following a second of said routes when said moveable wire path guide is in a second disposition wherein said wire exit loop is at a remove from the wire intake of the baling machine, alternating said path between said two routes by moving said moveable wire path guide between said two dispositions in response to operation of the baling machine.

19. The method of claim 18 wherein said second disposition maintains said wire exit loop at a raised elevation relative to said first disposition.

20. The method of claim 18 wherein said second disposition reduces slack in the wire between the wire supply and the wire intake of the baling machine.

21. The method of claim 18 wherein said second disposition provides greater clearance between said path and the baling machine.

22. The method of claim 18 further comprising biasing said movable wire path guide towards said second disposition; and overcoming said bias and moving said moveable wire path guide to said first disposition when the baling machine draws the wire from the wire supply through said moveable wire path guide with sufficient force.

23. The method of claim 18 wherein a distance between said wire exit loop in said two dispositions is comparable to a length of wire the baling machine draws to accomplish a single baling operation.

* * * * *

UNITED STATES PATENT AND TRADEMARK OFFICE

CERTIFICATE OF CORRECTION

PATENT NO. : 6,616,090 B1
DATED : September 9, 2003
INVENTOR(S) : Timothy Stamps It is certified that error appears in the above-identified patent and that said Letters Patent is hereby corrected as shown below:

Column 4,
Line 9, should read as follows:
-- said path of the wire and the baling machine. --
Line 54, should read as follows:
-- …..device including a wire storage implement…. --

Signed and Sealed this

Third Day of February, 2004

JON W. DUDAS
*Acting Director of the United States Patent and Trademark Office*